US006861992B2

(12) United States Patent
Kawakami et al.

(10) Patent No.: US 6,861,992 B2
(45) Date of Patent: Mar. 1, 2005

(54) ANTENNA

(75) Inventors: Kanji Kawakami, Teikyo University Staff Apartment B-208, 1-2, Toyosatodai, Utsunomiya-shi, Tochigi (JP); Iichi Wako, Tokyo (JP); Nobuyuki Matsui, Shizuoka (JP); Yoshiaki Fukuda, Tochigi (JP)

(73) Assignees: Hitachi Kokusai Electric Inc., Tokyo (JP); Kanji Kawakami, Tochigi (JP)

( * ) Notice: Subject to any disclaimer, the term of this patent is extended or adjusted under 35 U.S.C. 154(b) by 87 days.

(21) Appl. No.: 09/964,410

(22) Filed: Sep. 28, 2001

(65) Prior Publication Data

US 2002/0053992 A1 May 9, 2002

(30) Foreign Application Priority Data

Sep. 28, 2000 (JP) ..... P.2000-297604

(51) Int. Cl.[7] ..... H01Q 1/38; H01Q 7/04

(52) U.S. Cl. ..... 343/741; 343/841; 343/842; 343/867

(58) Field of Search ..... 343/741, 742, 343/787, 788, 841, 842, 866, 867

(56) References Cited

U.S. PATENT DOCUMENTS

| | | | | |
|---|---|---|---|---|
| 2,266,262 A | | 12/1941 | Polydoroff | |
| 3,594,805 A | * | 7/1971 | Chardin | 343/788 |
| 5,223,851 A | * | 6/1993 | Hadden et al. | 343/788 |
| 5,345,222 A | * | 9/1994 | Davies et al. | 343/841 |
| 5,495,259 A | | 2/1996 | Lyasko | |
| 5,691,731 A | | 11/1997 | van Erven | |
| 5,826,178 A | | 10/1998 | Owen | |

FOREIGN PATENT DOCUMENTS

| | | |
|---|---|---|
| DE | 44 07 116 A | 9/1995 |
| EP | 0 221 694 A | 5/1987 |

OTHER PUBLICATIONS

Marris, R.Q., "Experimental Quadriform Ferrite Transmit/Receive Antenna" Elektor Electronics, Elektor Publishers Ltd., Canterbury, GB, vol. 17, no. 194, Nov. 1, 1991, pp. 57–59, XP000307594.

Bessho, K. et al., "Analysis of a Novel Laminated Coil Using Eddy Currents for AC High Magnetic Field", IEEE Transactions on Magnetics, IEEE Inc., New York, US, vol. 25, no. 4, Jul. 1, 1989, pp. 2855–2857, XP000036018.

* cited by examiner

*Primary Examiner*—Michael C. Wimer
(74) *Attorney, Agent, or Firm*—Sughrue Mion, PLLC

(57) ABSTRACT

In an antenna for communicating an electromagnetic wave, a first converger converges the electromagnetic wave. A second converger faces the first converger and includes a conductor plate having a through hole, into which a magnetic flux of the converged electromagnetic wave is converged. The through hole is formed at a center portion of the conductor plate so as to have a size which is sufficiently smaller than a wavelength of the electromagnetic wave. The conductor plate is formed with a cutout extending from a part of the through hole to an outer periphery of the conductor plate. A converter faces the through hole of the conductor plate to convert the converged magnetic flux into voltage.

15 Claims, 5 Drawing Sheets

ANTENNA

BACKGROUND OF THE INVENTION

The present invention relates to an antenna which communicates an electromagnetic wave, and more particularly, to an antenna which can be used for waves ranging from an MF (medium frequency) band to a VHF (very high frequency) band and a UHF (ultra high frequency) band.

Related antennas can be roughly classified into the following five categories, according to operating principle.

A first type of antenna is one which produces a voltage as a result of an electric field acting on a conductor of linear shape or an analogous shape. A second type of antenna is one which produces a voltage across the ends of an annular conductor from an electromagnetic wave penetrating therethrough. A third type of antenna is one which converges an electromagnetic wave into an opening in a conductor by utilizing an eddy current developing around the opening. A fourth type of antenna is one which converges magnetic flux by a high-frequency magnetic substance and converts the magnetic flux into voltage by an electric coil. A fifth type of antenna is one which converges an electromagnetic wave by utilizing reflection developing in the surface of a parabolic conductor.

Specific names of these antennas as follows:

The first type of antenna includes an inverted L-shaped antenna used in a frequency band shorter than short wave, and a dipole antenna and a mono-pole antenna which are used for a high frequency band or higher. Further, the first type of antenna includes a Yagi antenna which is utilized for receiving an FM broadcast or a TV signal. The Yagi antenna is constituted by providing a dipole antenna with a wave director and a reflector.

The second type of antenna is called a loop antenna.

The third type of antenna is called a slot antenna. This slot antenna is employed by cell sites for a portable cellular phone or as a flat antenna for receiving satellite broadcast.

The fourth type of antenna is called a ferrite antenna or a bar antenna. A ferrite core is used as high frequency magnetic substance.

The fifth type of antenna is called a parabolic antenna. The parabolic antenna is used for communicating radio waves of higher frequency than VHF or is used as a radar antenna.

The maximum output voltage of each of the first and third antennas is defined as the product of field intensity and the length of an antenna. The first and third types of antennas possess the drawback of not being expected to be able to acquire a great antenna gain. In order to compensate for the drawback, a plurality of the third type of antennas are connected in parallel to acquire great output power at a load of low impedance.

The second type of antenna; that is, a loop antenna, is for detecting magnetic flux passing through a plane constituted of a coil. An output voltage of the loop antenna can be increased by increasing the size of a coil and the winding number thereof. However, when the winding number of a coil of great area is increased, the inductance of the coil and stray capacitance existing between lines of the coil are increased, thus reducing the resonance frequency of the coil. Since there is a necessity of selecting, as the resonance frequency, a frequency higher than a frequency to be used for communication, restrictions are imposed on the area of a coil and the winding number thereof.

The fourth type of antenna; that is, a ferrite antenna, enables reduction in the area of a coil by converging magnetic flux through use of a ferrite core. Since the winding number of a coil can be increased, the ferrite antenna has been widely adopted as a high-sensitivity MF antenna. At a frequency of higher than 1 MHz, permeability of ferrite magnetic material drops, in substantially inverse proportion to frequency. Since the highest operation frequency of magnetic material is about 10 GHz, the ferrite antenna possesses the drawback of not being able to be applied to frequencies of higher than the VHF range.

The fifth, parabolic antenna converges an electromagnetic wave through use of a parabolic reflection mirror, the outer dimension of the mirror being greater than the wavelength of a subject electromagnetic wave, thereby acquiring a high antenna gain. Since the antenna has high directionality, the antenna is used primarily for fixed stations.

SUMMARY OF THE INVENTION

The present invention has been conceived to solve the foregoing drawbacks and is aimed at providing an antenna which enables an increase in the winding number of a coil without involvement of drop in resonance frequency and which has a high voltage sensitivity and can be applied over a wide frequency range.

In order to achieve the above object, according to the present invention, there is provided an antenna, comprising:

a converger, including a conductor which converges a magnetic flux of an electromagnetic wave; and a converter, which coverts the converged magnetic flux into voltage.

According to the present invention, there is also provided an antenna for communicating an electromagnetic wave, comprising:

a first converger, which converges the electromagnetic wave;

a second converger, which faces the first converger and includes a conductor plate having a through hole, into which a magnetic flux of the converged electromagnetic wave is converged, formed at a center portion thereof so as to have a size which is sufficiently smaller than a wavelength of the electromagnetic wave, and a cutout extending from a part of the through hole to an outer periphery of the conductor plate; and a converter, which faces the through hole of the conductor plate to convert the converged magnetic flux into voltage.

According to the present invention, there is also provided an antenna, comprising:

a plurality of antenna elements, interconnected with each other, each antenna element including:

a converger, including a conductor which converges a magnetic flux of an electromagnetic wave; and a converter, which coverts the converged magnetic flux into voltage.

The first characteristic of the present invention lies in that magnetic flux of high frequency is converged into a minute area, by converging magnetic flux through utilization of the eddy current effect of a conductor plate of specific geometry. The second characteristic of the present invention lies in that a multiple-turn detection coil which has a small area and possesses a high resonance frequency converts the converged magnetic flux into voltage. The present invention embodies an antenna of high receiving sensitivity in a high frequency range through use of the above-described means.

As seen from publications (K. Bessho et al. "A High Magnetic Field Generator based on the Eddy Current Effect," IEEE Transactions on Magnetic, Vol. 22, No. 5, pp.

970–972, July 1986, and K. Bessho et al. "Analysis of a Novel Laminated Coil Using Eddy Currents for AC High Magnetic Field," IEEE Transactions on Magnetic, Vol. 25, No. 4, pp. 2855–2857, July 1989), magnetic flux converger constituted of a conductor has hitherto been used at low frequencies around a commercial frequency (50 Hz or 60 Hz). The magnetic flux converger is primarily applied to an electric device such as an electromagnetic pump.

The magnetic flux converger described in the publications is constituted by forming a small cutout in a conductor disk having a hole formed in the center thereof so as to extend from the hole to an outer periphery of the disk. Alternating magnetic flux developing in the direction perpendicular to the disk surface by the action of an eddy current is converged into the hole.

The publications teaches convergence of alternating magnetic flux produced by a magnetization coil. The publications make no statement about convergence of a magnetic flux component included in an electromagnetic wave.

The magnetic flux converger according to the present invention is basically identical in operation with the conductor plate described in the publications. However, the magnetic flux converger according to the present invention differs from the conductor plate described in the publications in that the magnetic flux converger is used in a considerably high frequency range from hundreds of kHz to GHz range.

The operation of the magnetic flux converger using the conductor plate will now be described with reference to FIGS. 1 and 2. FIG. 1 is a perspective view showing the appearance of the magnetic flux converger 1, and FIG. 2 is a cross-sectional view of the magnetic flux converger, showing the flow of alternating magnetic flux.

The magnetic flux converger 1 is constituted by forming a hole 3 in the center of a square conductor plate 2 and forming a cutout 4 so as to extend from the hole 3 to the periphery of the conductor plate 2.

When the conductor plate 2 is situated in a high frequency electromagnetic field in a direction perpendicular to a direction in which the electromagnetic field propagates (indicated by arrows in the figures), an eddy current 5 develops in the periphery of the conductor plate 2, as shown in FIG. 1. The eddy current 5 acts on the electromagnetic field so as to prevent the electromagnetic field from entering the conductor plate 2. In this case, as a result of the hole 3 and the cutout 4 being formed in the conductor plate 2, the eddy current 5 flows around the hole 3 and the cutout 4 in the direction opposite to that in which the eddy current 5 flows along the periphery. Hence, the eddy current 5 converges magnetic flux $\Phi$.

From the flow of alternating magnetic flux $\Phi$ shown in FIG. 2 it can be understood that magnetic flux is converged into an area substantially equal to the diameter of the hole 3 formed in the conductor plate 2.

So long as a coil whose diameter is slightly smaller than that of the hole 3 is disposed so as to be aligned with the center of the hole 3, the converged magnetic flux can be converted into voltage. It is commonly known that the inductance L of a coil is proportional to the square of the winding number of the coil and the area of the coil. Further, stray capacitance existing between lines of a coil is substantially proportional to the length of an electric wire of the coil. Hence, the capacitance can be diminished by reducing the diameter of the coil.

The area of the coil can be reduced by employment of the magnetic flux converger 1. Because of the foregoing reasons, reduction in the inductance and capacitance of the coil and rising in the resonance frequency of the coil can be achieved without involvement of reduction in the winding number. If the area of the coil is reduced, the same resonance frequency can be achieved even when the winding number of the coil is increased. Accordingly, for a given electromagnetic field intensity a greater receiving voltage can be achieved.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
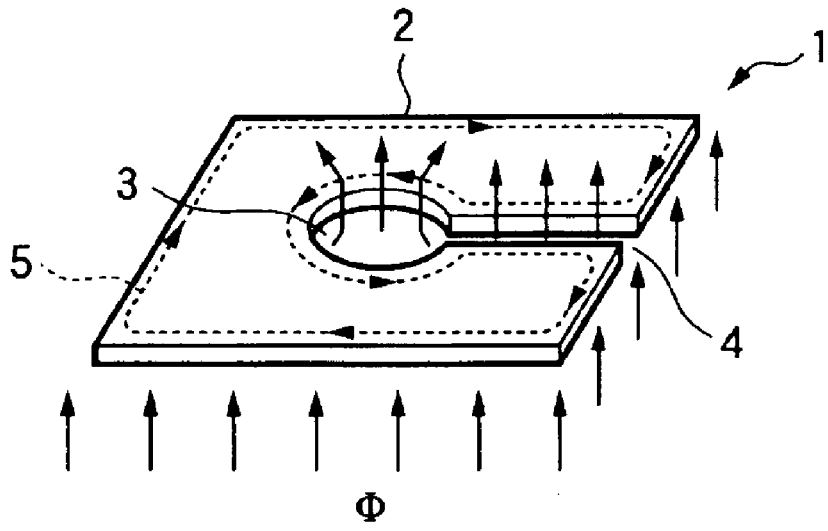
FIG. 1 is a perspective view of a conductor plate for describing the principle of magnetic flux converging employed in the present invention.

Embodiments of the present invention will be described hereinbelow with reference to the accompanying drawings.

First, a first embodiment of the present invention will be described with reference to FIGS. 3 to 5.

The antenna according to the present invention comprises a magnetic flux converger 1, an IC chip 10, and an electromagnetic flux converger 20. The magnetic flux converger 1 is constituted by forming a hole 3 in substantially the center of a square conductor plate 2, and a cutout 4 so as to extend from the hole 3 to a peripheral section of the conductor plate 2. The radius of the hole 3 is set to a value which is sufficiently smaller than the wavelength of a subject electromagnetic wave. A wall-like upright conductor 8 is orthogonally coupled on the conductor plate 2 along the periphery thereof, the hole 3, and the cutout 4. The upright conductor 8 is provided in the portion of the conductor plate 2 through which an eddy current flows intensively, for increasing the area in which the eddy current flows.

The IC chip 10 is constituted of a semiconductor integrated circuit including an amplifier, and a coil 11 is fabricated in a center of an upper face of the IC chip 10. The IC chip 10 is arranged such that the coil 11 is aligned with the hole 3 of the conductor plate 2. The IC chip 10 is closely fixed to the lower side of the conductor plate 2 via, e.g., a dielectric layer.

The electromagnetic flux converger 20 is constituted by forming a slot 22 in substantially the center of a conductor plate 21 sufficiently larger than the conductor plate 2. A wall-like upright conductor 23 is orthogonally coupled on an upper face of the conductor plate 21 along a periphery of a slot 22 through which an eddy current flows intensively. The upright conductor 23 is provided for increasing the area in which the eddy current flows.

The outer dimension of the magnetic flux converger 1; that is, the outer dimension of the upright conductor 8, and the inside dimension of the slot 22 of the electromagnetic flux converger 20 are set to a value which is about one-half the wavelength of a subject electromagnetic wave. The outer periphery of the magnetic flux converger 1 and the inner periphery of the slot 22 are formed into substantially the same square. The electromagnetic flux converger 20 is stacked on the magnetic flux converger 1 in an insulated manner. The above example has described a case where the conductor plate 2 of the magnetic flux converger 1 and the slot 22 of the electromagnetic flux converger 20 are formed into a square. The only requirement is that at least one side of the conductor plate 2 and one side of the slot 22 are set to substantially one-half the wavelength of a subject electromagnetic wave. The conductor plate 2 and the slot 22 are not limited to a square. More specifically, the geometry of the conductor plate 2 of the magnetic flux converger 1 and that of the slot 22 of the electromagnetic flux converger 20 can be set arbitrarily in accordance with the type of polarized wave. Further, even when a superconductor is employed for the magnetic flux converger 1 and the electromagnetic flux converger 20, there is yielded the same result as that yielded when an ordinary conductor is used.

The operation of the antenna according to the present embodiment will now be described.

The operation of the entire antenna is described with reference to FIG. 4, which is a cross-sectional view of FIG. 3. In FIG. 4, the direction in which an external alternating magnetic flux Φ is imparted is shown upside down in relation with that shown in FIGS. 1 and 2.

When an electromagnetic wave considered to be uniform has arrived at the antenna, the electromagnetic flux converger 20 first converges the electromagnetic wave. The electromagnetic flux converger 20 operates according to the same principle as that of a related slot antenna. An electromagnetic field is converged into the slot 22 by an eddy current flowing around the slot 22 whose size is one-half the wavelength of the subject electromagnetic wave. The upright conductor 23 around the slot 22 is provided for reducing electrical resistance against the eddy current. The upright conductor 23 operates in the same manner as the upright conductor 8 provided in the magnetic flux converger 1.

The magnetic flux converger 1 converges magnetic flux into an area of the hole 3 having a sufficiently smaller diameter than the wavelength of the subject electromagnetic wave received by the magnetic flux converger 1, regardless of the wavelength of the electromagnetic wave. The operation of the magnetic flux converger 1 is as described with reference to FIGS. 1 and 2.

In the present invention, the upright conductor 8 is provided on the conductor plate 2 for increasing an eddy current flowing in the magnetic flux converger 1. The operation of the upright conductor 8 is now be described.

As the frequency of an eddy current increases, the eddy current concentrates on the edge of the conductor plate 2 due to the skin effect. The width of concentration of the eddy current is called the skin depth "s" and is defined by the following equation (1).

$$s = \sqrt{\frac{2\rho}{\omega\mu}} \tag{1}$$

where ρ denotes resistivity of a conductor plate, ω denotes angular velocity, and $\mu$ denotes permeability of the conductor plate.

The permeability $\mu$ of a non-magnetic conductor is substantially equal to the permeability of a vacuum; that is, a value of $4\pi\times10^{-7}$[H/m]. In the case where copper is used as material of the conductor plate, conductivity ρ is $1.6\times10^{-8}$ [Ω·m]. From these values, the skin depth "s" at 100 MHz assumes a value of about 6.4 $\mu$m.

Provided that the length of the entire eddy current flowing path is taken as $L_{ed}$ and the thickness of the conductor plate 2 is taken as T, the electrical resistance $R_{ed}$ of the conductor plate 2 against the eddy current is defined by the following equation (2).

$$R_{ed} = \frac{\rho L_{ed}}{sT} \tag{2}$$

where ρ denotes the resistivity of a conductor material. When copper is used as material of a conductor, resistivity ρ assumes a value of $1.6\times10^{-8}$[Ω·m].

Specifically, the resistance $R_{ed}$ of the conductor plate 2 is inversely proportional to the skin depth "s" and the thickness T of the conductor plate. In consideration of a case where angular velocity (frequency) ω and resistivity ρ of the conductor plate 2 are defined by the variables, the skin depth "s" becomes a fixed value. The length $L_{ed}$ of the eddy current flowing path is defined so as to become substantially proportional to the wavelength of the electromagnetic wave (i.e., the reciprocal of a frequency). Hence, it is evident that the length $L_{ed}$ cannot be reduced greatly. In contrast, the thickness T of the conductor plate 2 has a wide range of selection. Accordingly, the resistance $R_{ed}$ of the conductor plate 2 can be reduced by increasing the thickness T of the conductor plate 2. Reduction in the resistance $R_{ed}$ can be achieved, by increasing the thickness of only an area of the conductor plate 2 in which an eddy current flows. Hence, it is obvious that the geometry of the upright conductor 8 formed only along the periphery of the conductor plate 2 of the magnetic flux converger 1 and the geometry of the upright conductor 23 formed only along the periphery of the slot 22 of the electromagnetic flux converger 20 are preferable.

Desirably, the thickness of the upright conductor 8 or that of the upright conductor 23 is greater than the skin depth "s." As mentioned above, the thickness of the upright conductor 8 and 23 is preferably several micrometers. Hence, the upright conductors 8 and 23 can be embodied by use of a technique such as electric deposition or electroless deposition. For example, conductive material, such as copper, is deposited on an interior surface of a female mold formed of, e.g., organic material, through deposition. As a result, the magnetic flux converger 1 and the electromagnetic flux converger 20, which possess complicated geometry such as that shown in FIG. 3, can be manufactured at lower cost.

Application of the above-described manufacturing method facilitates setting of the diameter of the hole 3 formed in the magnetic flux converger 1 to a value of 1 mm or less. Further, the dimension of the magnetic flux converger 1 and that of the electromagnetic flux converger 20 become smaller in a higher frequency range, thus requiring a more minute female mold. When the antenna is applied to an electromagnetic wave of, e.g., 30 GHz, one side of the magnetic flux converger 1 assumes a size of 5 mm, and the hole 3 must be finished so as to assume a size of tens of micrometers to hundreds of micrometers. In this case, the objective is achieved by applying a photolithography technique to finishing of the hole 3 through use of a photosensitive plastic film used for manufacturing a printed wiring board.

As is evident from the foregoing description, the upright conductor 8 is provided on the conductor plate 2 of the magnetic flux converger 1, and the upright conductor 23 is provided on the conductor plate 21 of the electromagnetic flux converger 20. As a result, flow of an eddy current into the magnetic flux converger 1 and the electromagnetic flux converger 20 can be increased, thereby enhancing the converging effect.

As mentioned above, magnetic flux Φ is converged into the hole 3 formed in the magnetic flux converger 1. The thus-converged magnetic flux penetrates through the coil 11, thereby producing a voltage across the terminals of the coil 11. It is evident that formation of the coils 11 on a semiconductor integrated circuit results in the following two advantages.

The first advantage is that the coil 11 can be made small. As is well known, an interconnection having a width of 1 μm or less can be easily formed on a semiconductor integrated circuit.

The second advantage is that electrical connection between terminals of the coil 11 and an electric circuit such as an amplifying circuit or a rectifying circuit can be established within processes for fabricating a semiconductor integrated circuit. When the coil 11 and electronic circuits are formed separately, there is a necessity for use of a connection pad having a side of at least 100 μm or more for electrically connecting the coil 11 with the electronic circuits. In this case, electrostatic stray capacitance arises in the connection pad, thereby yielding an adverse influence of reducing the resonance frequency of the coil 11. Accordingly, fabricating the coil 11 on a semiconductor integrated circuit obviates operations required for electrical connection. There is yielded an advantage of the antenna according to the present invention being applied to a high frequency range.

Next, electrical operation will be described with reference to FIG. 5.

Figure 4:
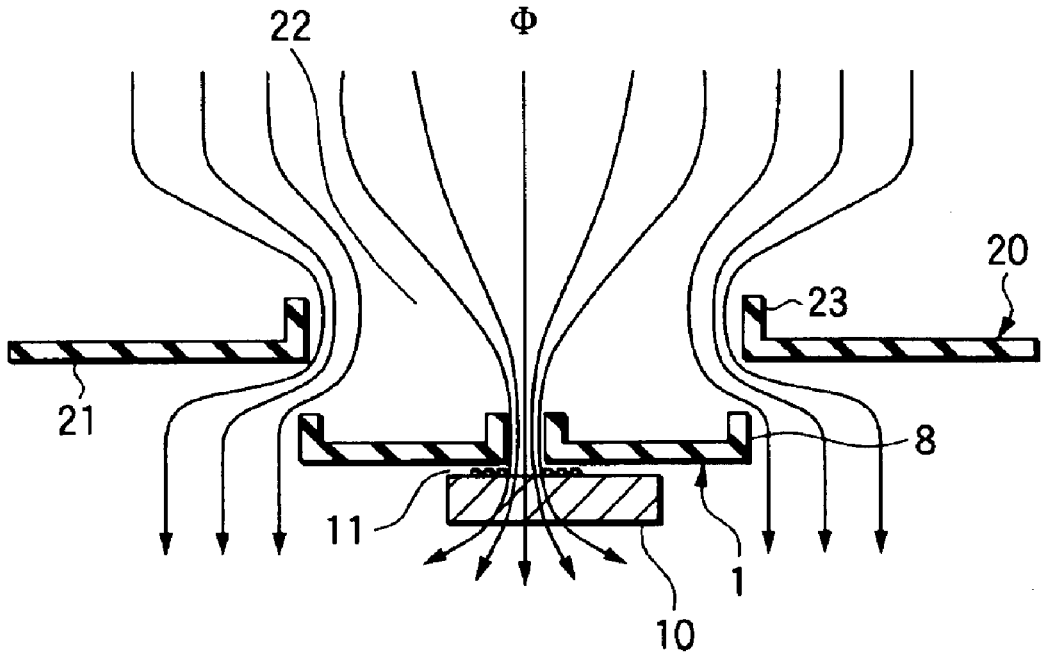
FIG. 4 is a cross-sectional view of an antenna of FIG. 3.
Figure 5:
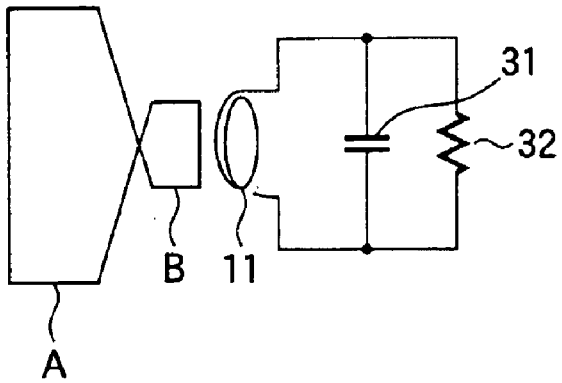
FIG. 5 is an illustration of an equivalent circuit of a magnetic flux converger and a coil employed in the antenna of FIG. 3.

FIG. 5 shows an equivalent circuit of the magnetic flux converger 1 and the coil 11. A loop A and a loop B correspond to an eddy current flowing path of the magnetic flux converger 1. More specifically, the loop A corresponds to the outer periphery of the conductor plate 2 of the magnetic flux converger 1, and the loop B corresponds to the hole 3 formed in the conductor plate 2. As can be seen from FIG. 4, the loop B and the coil 11 are magnetically coupled together. It is obvious that the loop B and the coil 11 operate in a manner equivalent to that of a transformer. At this time, provided that the loop B serving as a primary winding has one turn and that the coil 11 has N turns, the voltage developing across the coil 11 becomes N times that of the loop B. Accordingly, if a large number is selected for the winding number N of the coil 11, the sensitivity of the antenna can be increased.

The winding number N cannot be increased without limitation, because a resonance frequency $f_c$ (defined by the inductance L of the coil 11, by the capacitance C of the coil 11, and by the capacitance C of the electrostatic stray capacitance 31 of an electric circuit including the coil 11) must be made higher than a frequency $f_r$ to be received by the antenna. It is well known that the inductance L of the coil 11 is proportional to the product of the square of the winding number N of the coil and the internal area of the coil. Of the capacitance C of the electrostatic stray capacitance 31, line capacitance of the coil 11 is substantially proportional to the product of the line length of the coil and (N−1)/N. If the winding number N is sufficiently greater than 1, the line capacitance is approximately proportional to the line length of the coil. As shown in FIGS. 3 and 4, when the coil 11 is formed in close proximity to the surface of the conductor plate 2, the electrostatic stray capacitance 31 between the coil 11 and the conductor plate 2 is proportional to the line length of the coil 11. Accordingly, it is analogously thought that the total capacitance C of the electrostatic stray capacitance 31 is proportional to the length of the line. Referring to FIG. 5, reference numeral 32 designates load resistance; e.g., input impedance of an amplifying circuit.

When the coil 11 assumes a circular shape having a radius "r," the area of the coil 11 is proportional to "$r^2$." Further, the line length of the coil is proportional to "N·r." More specifically, the inductance L of the coil 11 is proportional to $(N\cdot r)^2$. Further, the capacitance C of the electrostatic stray capacitance 31 is proportional to "N·r." Accordingly, as expressed by equation (3), the resonance frequency $f_c$ is inversely proportional to $(N\cdot r)^{3/2}$. The result shows that the radius "r" of the coil 11 must be made smaller in order to increase the resonance frequency $f_c$ of the coil 11 having a large winding number N.

$$f_c = k_1 \frac{1}{\sqrt{LC}} = k_2 \frac{1}{\sqrt{(Nr)^2 (Nr)}} = k_2 (Nr)^{-\frac{3}{2}} \tag{3}$$

where $k_1$ and $k_2$ denote coefficients, N denotes the winding number of a coil, and "r" denotes the radius of the coil.

As is evident from the foregoing description, in the antenna according to the present invention, the radius of the hole 3 of the magnetic flux converger 1 is selected so as to become considerably smaller than the wavelength of an electromagnetic wave. Hence, the winding number N of the coil 11 can be increased without involvement of drop in the resonance frequency $f_c$ of the coil 11.

Although the first embodiment has described the antenna to which is applied the magnetic flux converger 1 constituted of an electrically-continuous single conductor plate 2, the principle of the gist of the present invention is not limited to the embodiment. As shown in FIG. 6, it is evident that an electrically-divided conductor plates 2 may be employed.

Figure 6A:
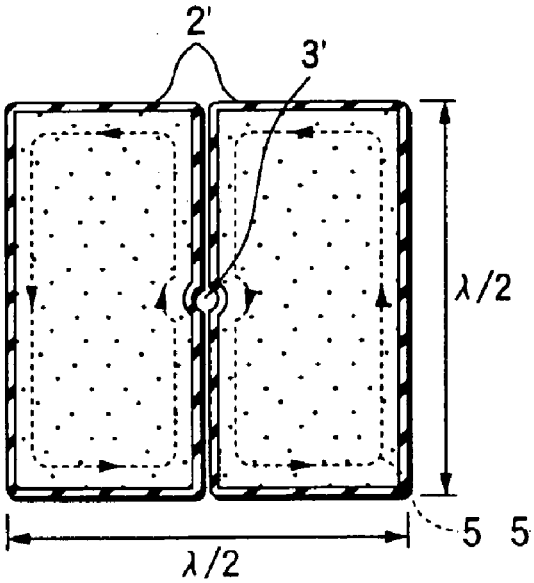
FIGS. 6A and 6B are plan views showing a magnetic flux converger of an antenna according to a second embodiment of the present invention.

FIG. 6A shows that two conductor plates 2' are arranged symmetrically, wherein each conductor plate 2 measures a half wavelength× a quarter wavelength. In this case, an equivalent hole 3' is formed by denting the center of the sides of the two conductor plates 2' where they meet each other.

As shown in FIG. 6A, the eddy current 5 flows in a single direction in the two conductor plates 2'. The area where the dents oppose each other acts as the equivalent hole 3'.

Figure 2:
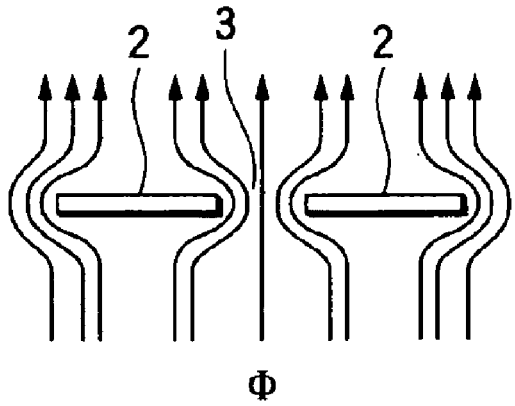
FIG. 2 is a cross-sectional view of the conductor plate of FIG. 1.
Figure 6B:
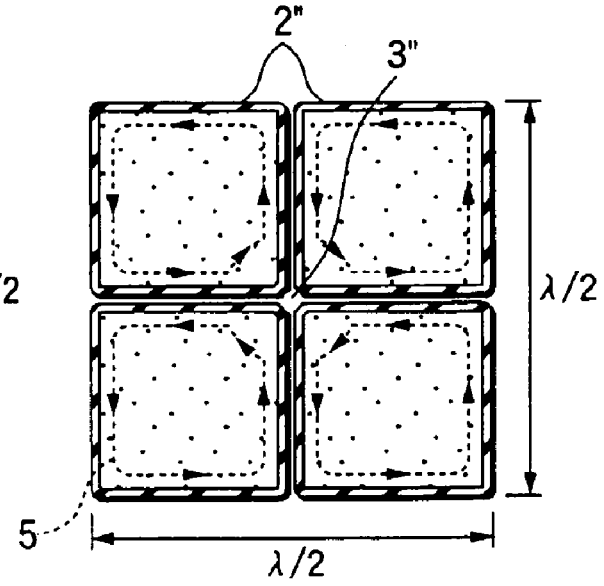

As is clear from comparison with FIG. 1, the length of a channel of the eddy current 5 is shortened. Hence, there is an advantage of the ability to reduce resistance $R_{ed}$ against the eddy current 5. Further, as shown in FIG. 6B, four conductor plates 2", each having a side of quarter wavelength, are arranged, thereby further shortening an eddy current flowing path. Thus, the resistance $R_e$ can be diminished to a much greater extent. In this case, corners located at the center of the four conductor plates 2" are dented inwardly, thus forming an equivalent hole 3".

Figure 7:
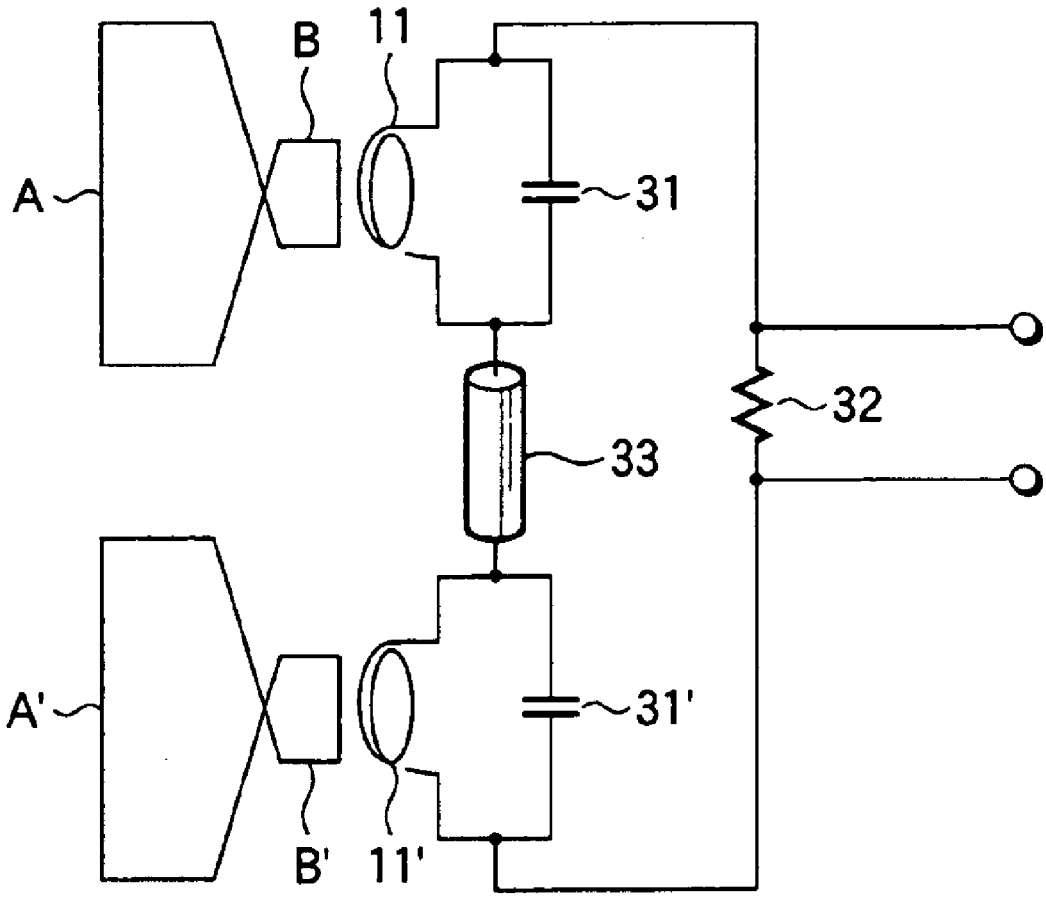
FIG. 7 shows an equivalent circuit of an antenna according to a third embodiment of the present invention.

A third embodiment of the present invention will now be described. In the third embodiment, a plurality of antennas according to the present invention are arranged in a manner as shown in FIG. 7. FIG. 7 is an equivalent circuit representing a state that a plurality of antennas are interconnected.

Figure 3:
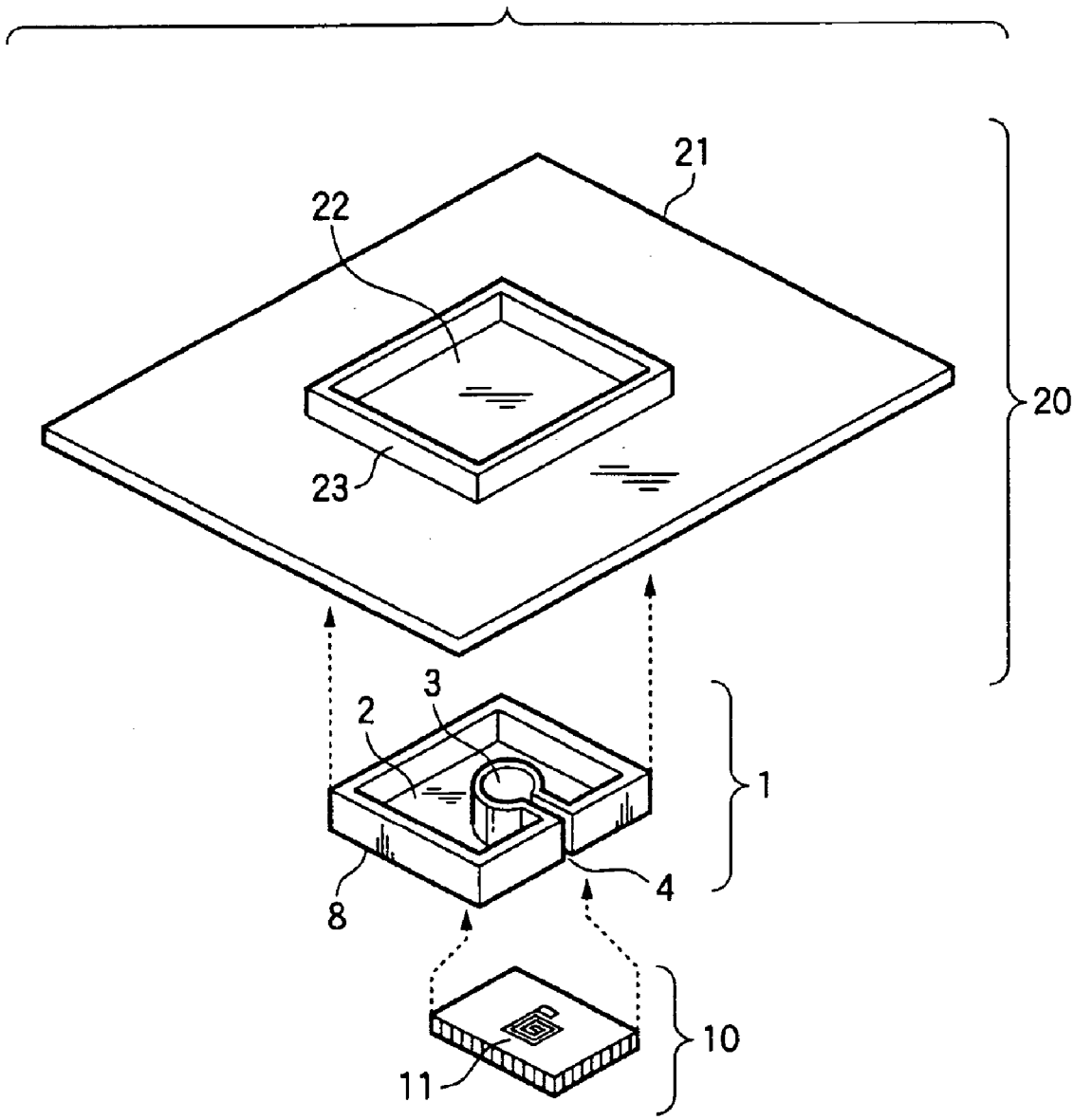
FIG. 3 is an exploded perspective view showing an antenna according to a first embodiment of the present invention.

A plate electrode called a patch is placed in a position corresponding to the slot 22 of the electromagnetic flux converger 20 shown in FIG. 3, thus constituting a set of antenna. A plurality of antenna sets are used in an arranged manner for receiving satellite broadcast, for example. In this case, patch voltages of the individual patches cannot be added together. Hence, the antennas are connected in parallel with each other for the purpose of supplying heavy power to a load of low impedance.

The coil 11 of the antenna according to the present invention operates independently of a ground-plane potential. Hence, a plurality of coils 11 and 11" of antennas are connected in series, as shown in FIG. 7, thereby enabling addition of voltages developing in the coils 11 and 11'. When the voltages are added together, there is a necessity of eliminating a phase delay existing at a point at which the voltages of the coils 11 and 11' are added together. One method is to match the length of a wire of the coil 11 with that of a wire of the coil 11' at a point where the voltage of the coil 11 and that of the coil 11' are added together. Another method is to connect the two coils 11 and 11' together via a delay line 38, as shown in FIG. 7. After the phase of a voltage has been shifted 360° relative to the phase of a voltage output from a coil having no delay through use of the delay line 33, the voltages of the two coils are added together.

The speed of signals propagating in a printed wiring board is slightly greater than half light speed. Since the magnetic flux converger 1 has a size of a half of the wavelength of the electromagnetic wave, the objective can be achieved by electrically interconnecting the magnetic flux converger 1 and the coil 11 via the printed wiring board such that an interval between the magnetic flux converger 1 and the coil 11 is set so as to be slightly greater than the size. If the winding direction of the coil 11 is made opposite to that of the coil 11', the phase of the voltage output from the coil 11 becomes 180° out of phase with that of the voltage output from the coil 11'. Hence, a delay line for shifting a phase through only 180° may be adopted as the delay line 33.

Leaving a wave director in a commercially-available Yagi antenna for UHF band, a dipole antenna thereof was replaced with the magnetic flux converger 1 according to the present invention. Further, the coil 11 having two turns was employed. Results of detection tests were performed through use of the thus-modified antenna and a commercially-available Yagi antenna. The test results show that the modified antenna acquired a voltage sensitivity of 5.7 dB (i.e., 1.8 times as large as that obtained by a commercially-available Yagi antenna). The dipole antenna of a standard Yagi antenna can be deemed as a single-turn coil. It can be understood that the sensitivity has been increased substantially proportional to an increase in the winding number of the coil.

As is evident from the test results, the electromagnetic flux converger 20 is not limited to a planar structure shown in FIG. 3 but may be embodied as a wave director employed in a standard Yagi antenna.

Even when the IC chip shown in FIG. 3 is embodied as a support member of a simple coil 11 having no amplifying function, it is evident that the nature of the present invention is not changed.

An attempt has recently been made to transmit power in the form of microwaves. To this end, it is obvious that the IC chip 10 may be replaced with a semiconductor chip having formed therein a rectification diode or a rectification diode bridge.

Furthermore, the IC chip 10 may be replaced with a semiconductor chip provided as a transponder which communicate power with a reader antenna while modulation is performed.

As has been described in detail, in the present invention, an electromagnetic wave is converged by magnetic flux converger constituted of a conductor plate. The thus-converged magnetic flux is converted into voltage by a coil. Hence, the area of the coil can be reduced, and the winding number of the coil can be increased without involvement of drop in resonance frequency. Thus, there can be embodied an antenna of high voltage sensitivity. Magnetic material is not used for magnetic flux converger, and an eddy current effect of a conductor appearing in a wide range of frequency is utilized. Hence, the antenna can be applied to a frequency range from hundreds of kHz to tens of GHz.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna, comprising:

a converger, including a conductor which converges a magnetic flux of an electromagnetic wave, the converger having a through hole, into which the magnetic flux is converged, at a center portion of the conductor, and a cutout extending from a part of the through hole to an outer periphery of the conductor; and a converter, which coverts the converged magnetic flux into voltage, wherein the magnetic flux is converged by an eddy current flowing on the conductor so as to have a path length which is at least one wavelength of the electromagnetic wave, and the through hole has a size which is sufficiently smaller than the wavelength of the electromagnetic wave.

2. The antenna as set forth in claim 1, wherein the converger includes a resistance reducer provided on at least a peripheral portion of the conductor to reduce resistance against current flowing in the conductor.

3. The antenna as set forth in claim 1, wherein the conductor comprises a plurality of sub-plates.

4. The antenna as set forth in claim 1, wherein the converter comprises a coil.

5. The antenna as set forth in claim 1, wherein the converter has a size which is sufficiently smaller than a wavelength of the electromagnetic wave.

6. The antenna as set forth in claim 4, wherein a winding number of the coil is at least two.

7. The antenna as set forth in claim 1, wherein the converter is formed on a semiconductor integrated circuit.

8. An antenna for communicating an electromagnetic wave, comprising:

a first converger, which converges the electromagnetic wave;

a second converger facing the first converger and including a conductor plate having a through hole, into which a magnetic flux of the converged electromagnetic wave is converged, formed at a center portion thereof so as to have a size which is sufficiently smaller than a wavelength of the electromagnetic wave, and a cutout extending from a part of the through hole to an outer periphery of the conductor plate; and a converter, which faces the through hole of the conductor plate to convert the converged magnetic flux into voltage.

9. The antenna as set forth in claim 8, wherein the second converger includes an upright conductor formed along an outer peripheral portion of the conductor plate, the through hole and the cutout, so as to extend in an orthogonal direction of a direction in which the conductor plate extends.

10. The antenna as set forth in claim 8, wherein the first converger includes a conductor plate having a slot formed at a center portion thereof and an upright conductor formed along an outer periphery of the conductor plate so as to extend in an orthogonal direction of a direction in which the conductor plate extends.

11. The antenna as set forth in claim 10, wherein each of the slot of the first converger and the outer periphery of the conductor plate of the second converger has a linear portion whose dimension is substantially a half of a wavelength of the electromagnetic wave.

12. The antenna as set forth in claim 8, wherein the converter comprises a coil.

13. An antenna, comprising:

a plurality of antenna elements, serially interconnected with each other, each antenna element including:

a converger, including a conductor which converges a magnetic flux of an electromagnetic wave; and a converter, which coverts the converged magnetic flux into voltage, the converter being operable independently from a ground potential, wherein the magnetic flux is converged by an eddy current flowing on the conductor so as to have a path length which is at least one wavelength of the electromagnetic wave, and the conductor is formed with a through hole having a size which is sufficiently smaller than the wavelength of the electromagnetic wave.

14. The antenna as set forth in claim 13, wherein the antenna elements are interconnected such that voltages outputted from the respective converters are added.

15. The antenna as set forth in claim 14, wherein a phase delay between voltages outputted from the respective converters is eliminated on the way from the converters to a point at which the output voltages are added.

* * * * *